US008113907B2

(12) United States Patent
Liu

(10) Patent No.: US 8,113,907 B2
(45) Date of Patent: Feb. 14, 2012

(54) SIMULATED EYE FOR TOY

(75) Inventor: Bao-Shuai Liu, Shenzhen (CN)

(73) Assignees: Hong Fu Jin Precision Industry (ShenZhen) Co., Ltd., Shenzhen, Guangdong Province (CN); Hon Hai Precision Industry Co., Ltd., Tu-Cheng, New Taipei (TW)

( * ) Notice: Subject to any disclaimer, the term of this patent is extended or adjusted under 35 U.S.C. 154(b) by 387 days.

(21) Appl. No.: 12/545,091

(22) Filed: Aug. 21, 2009

(65) Prior Publication Data

US 2010/0120325 A1 May 13, 2010

(30) Foreign Application Priority Data

Nov. 7, 2008 (CN) ..... 2008 1 0305423

(51) Int. Cl.
*A63H 3/40* (2006.01)

(52) U.S. Cl. ..... 446/343; 446/392; 396/427; 396/428

(58) Field of Classification Search ..... 446/337–350, 446/392, 236; 396/427, 428; 343/765, 766
See application file for complete search history.

(56) References Cited

U.S. PATENT DOCUMENTS

| | | | | |
|---|---|---|---|---|
| 2,984,936 | A * | 5/1961 | Wilhelm et al. | 446/344 |
| 3,081,997 | A * | 3/1963 | Glass et al. | 472/70 |
| 3,252,338 | A * | 5/1966 | Senger | 74/5.6 D |
| 3,462,876 | A * | 8/1969 | Kirschenmann | 446/342 |
| 3,478,465 | A * | 11/1969 | Wilhelm | 446/346 |
| 3,691,788 | A * | 9/1972 | Mazziotti | 403/122 |
| 4,634,889 | A * | 1/1987 | Foggia et al. | 343/766 |
| 5,280,225 | A * | 1/1994 | Pine et al. | 318/575 |
| 5,476,018 | A * | 12/1995 | Nakanishi et al. | 74/5.7 |
| 5,959,758 | A * | 9/1999 | Seo | 359/198.1 |
| 6,343,184 | B1 * | 1/2002 | Huebner | 396/428 |
| 6,549,726 | B2 * | 4/2003 | Huebner | 396/428 |
| 6,803,738 | B2 * | 10/2004 | Erten | 318/653 |
| 7,174,647 | B2 * | 2/2007 | Krantz et al. | 33/286 |
| 7,209,164 | B2 * | 4/2007 | Nishimura et al. | 348/207.99 |
| 7,446,813 | B2 * | 11/2008 | Nakamoto et al. | 348/374 |
| 7,710,337 | B2 * | 5/2010 | Blalock | 343/757 |
| 7,909,521 | B2 * | 3/2011 | Son | 396/428 |
| 2010/0105281 | A1 * | 4/2010 | Su | 446/343 |
| 2011/0066239 | A1 * | 3/2011 | Smoot et al. | 446/392 |

* cited by examiner

*Primary Examiner* — Gene Kim
*Assistant Examiner* — Urszula M Cegielnik
(74) *Attorney, Agent, or Firm* — Altis Law Group, Inc.

(57) ABSTRACT

A simulated eye is capable of being rotatable in a first direction and a second direction. The simulated eye includes an eyeball, a housing for receiving the eyeball, and a holding member. The eyeball is rotatably connected to the holding member, and the eyeball is rotatable relative to the holding member in a first direction. The holding member is pivotally connected to the housing, and the holding member holding the eyeball is rotatable relative to the housing in a second direction.

6 Claims, 3 Drawing Sheets

SIMULATED EYE FOR TOY

BACKGROUND

1. Technical Field

The disclosure relates to toys and, more particularly, to a simulated eye for a toy.

2. Description of Related Art

As the development of the electronic technology, more and more robot toys imitate human's actions, such as, walking, jumping, and so on. The eyes play a huge role in a lot of facial expressions. The eyes of some robot toys simulate human eyes by imitating various shapes of the human eyes. However, some of these imitations are restricted to the eyelids opening and closing, and accordingly, other simulation effect of the eyes of the robot toys are needed to make the robot looks more lifelike. Therefore, what is needed is a simulated eye capable of simulating human eyes' actions.

BRIEF DESCRIPTION OF THE DRAWINGS

The components of the drawings are not necessarily drawn to scale, the emphasis instead being placed upon clearly illustrating the principles of the embodiments of the simulated eye. Moreover, in the drawings, like reference numerals designate corresponding parts throughout several views.

DETAILED DESCRIPTION

Figure 1:
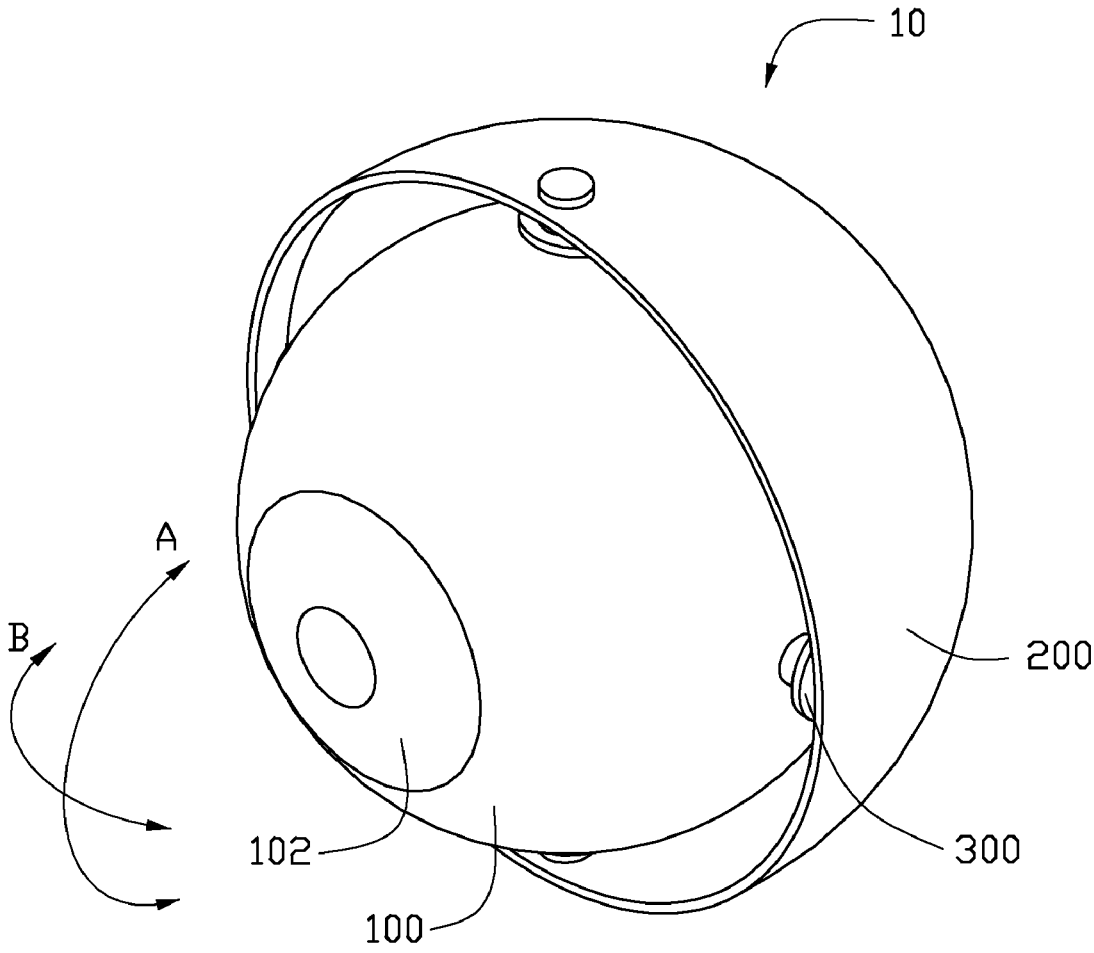
FIG. 1 is a perspective view of a simulated eye in accordance with one embodiment.

Referring to FIG. 1, a simulated eye 10 is rotatable in different directions, in the embodiment, the simulated eye 10 can be rotated at least in a first direction A and a second direction B. The first direction A is perpendicular to the second direction B. The first direction A may be an up-down direction and the second direction B may be a left-right direction.

The simulated eye 10 includes a spherical eyeball 100, a partially-spherical housing 200 for receiving the eyeball 100, and a holding member 300. The eyeball 100 is rotatably mounted in the holding member 300. The holding member 300 holds the eyeball 100, and is pivotally mounted to an inner surface of the housing 200.

Figure 2:
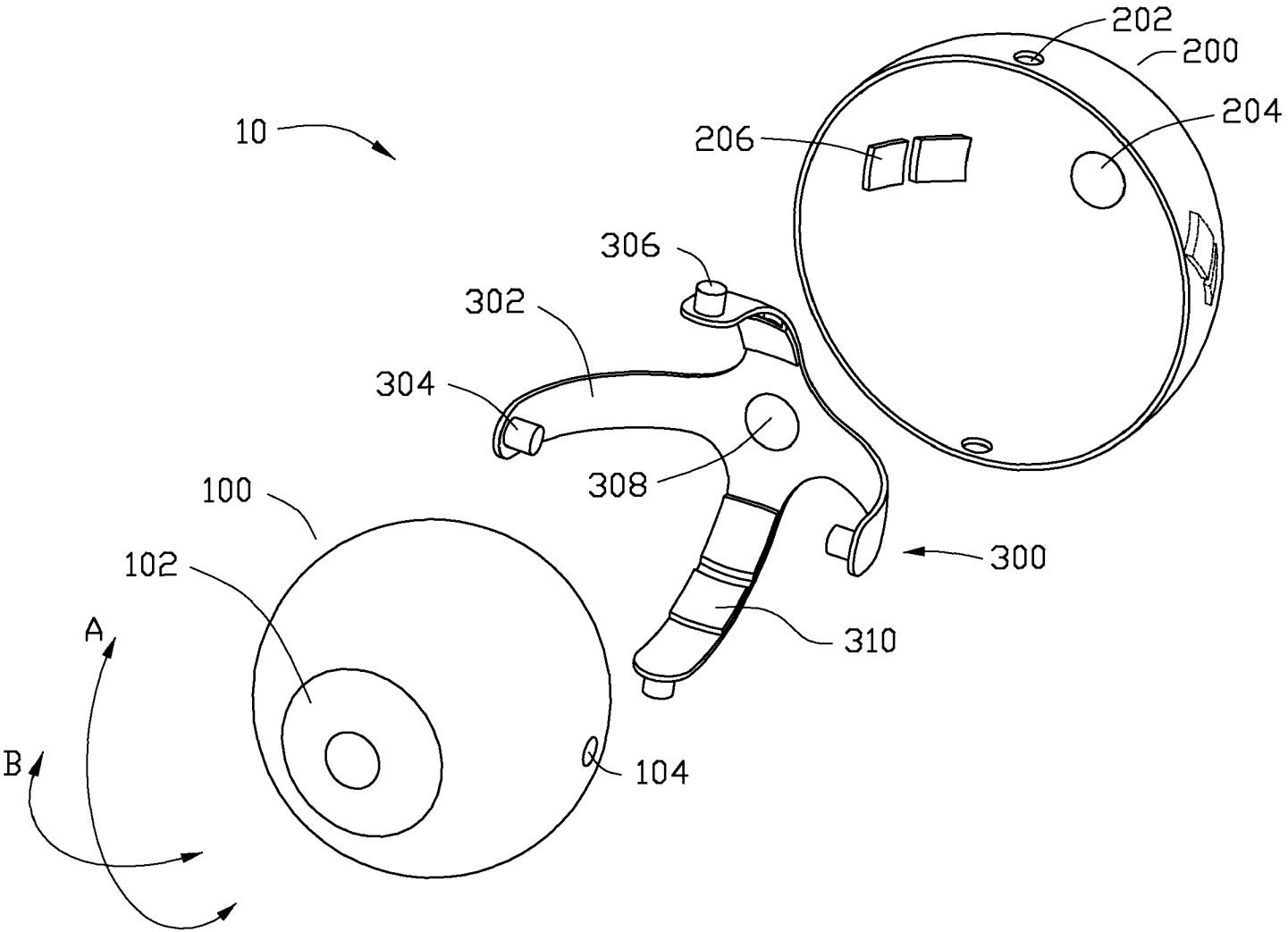
FIG. 2 is a exploded view of the simulated eye of FIG. 1.
Figure 3:
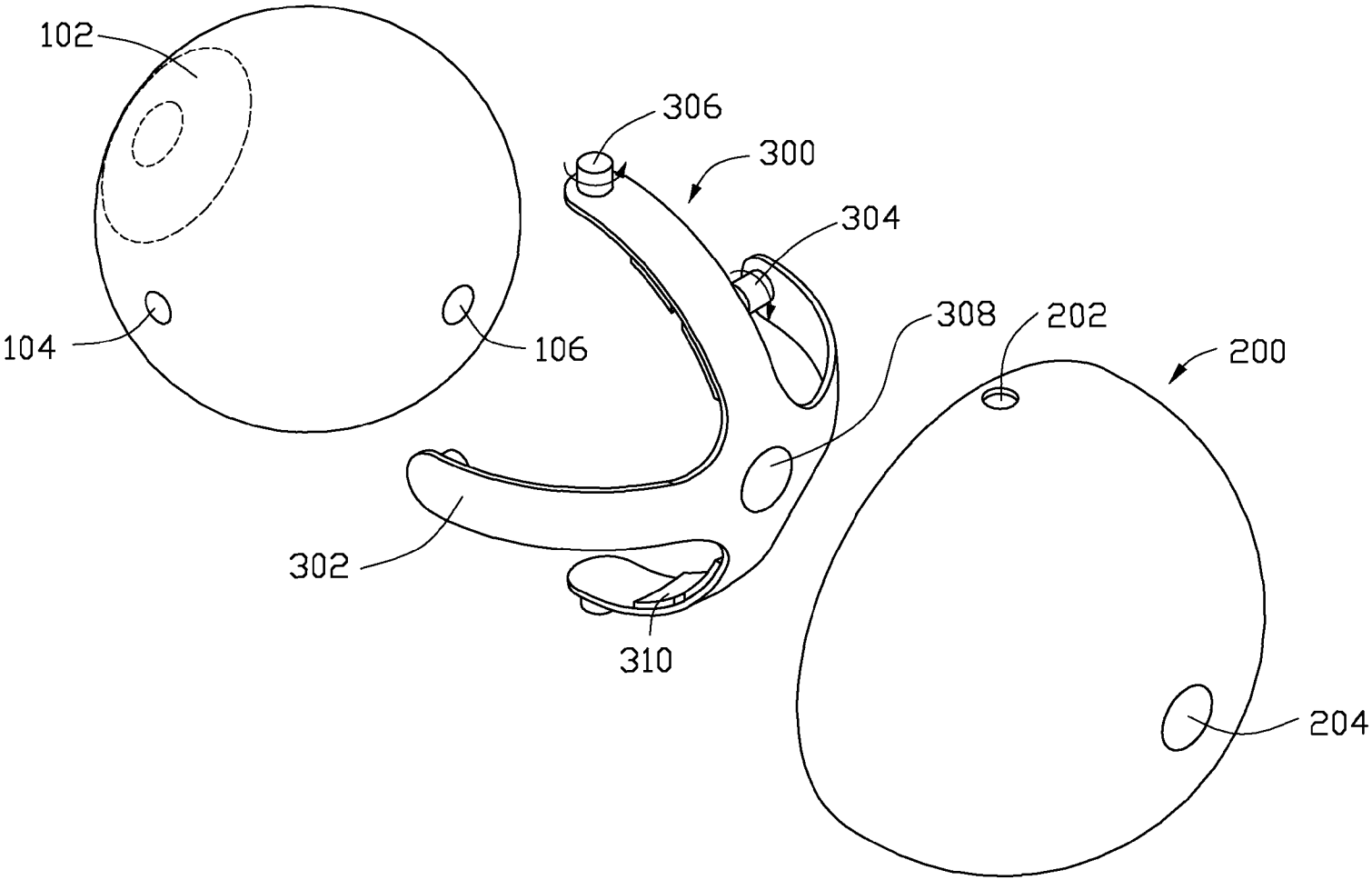
FIG. 3 is also a exploded view similar to FIG. 2, but viewed from another aspect.

Referring to FIGS. 2 and 3, an iris 102 is disposed on the eyeball 100. two recesses 104 are defined in opposite sides of the eyeball 100 correspondingly. The two recesses 104 are aligned in a straight line (not shown) extending through a center of the eyeball 100. In other embodiment, the two recesses 104 may be through holes. A first magnetic member 106 is mounted on the eyeball 100 opposite to the iris 102. The magnetic member described herein and below may be a magnet and/or metal attractable by a magnet.

The holding member 300 includes four curved arms 302. The four curved arms 302 distributed in cruciform symmetry are extended in the same direction and have substantially the same curvature corresponding the eyeball 100. The four arms 302 are fixed together to receive the eyeball 100. Two columned first protrusions 304 protrude from inner sidewalls of opposite arms 302 correspondingly. Two columned second protrusions 306 protrude from outer sidewalls of the other opposite arms 302 respectively. The first protrusions 304 may be substantially coplanar with the second protrusions 306. A magnet 308 is mounted at the intersection of the curved arms 302, and at least one first electromagnet 310 is mounted on the inner sidewall of each arm 302 having the protrusion 306. The first electromagnet 310 may be selectively activated to attract the first magnetic member 106, such that the eyeball 100 is driven directly by the first electromagnet 310 to rotate relative to the holding member 300.

Two round holes 202 are defined in the semispherical housing 200. The two round holes 202 are on opposite sides of the semispherical housing 200 and aligned along a circular line adjacent the circular edge of the 200. A second magnetic member 204 is mounted at the bottom end of the housing 200. Two second electromagnets 206 are mounted on an inner surface of the housing 200. The two electromagnets 206 are disposed on opposite sides of the housing 200, and the two electromagnets 206 lie along a line around the housing 200 orthogonal to that of the round holes 202. The second electromagnets 206 may be activated to attract the magnet 308, such that the eyeball 100 is driven indirectly to rotate relative to the housing 200 through the holding member 300. Furthermore, the first electromagnets 310 and the second electromagnets 206 are electrically connected to a power source (not shown) for supplying power thereto.

In assembly, the two first protrusions 304 are engaged with the two recesses 104, therefore, the eyeball 100 is partially received in the holding member 300 and is pivotally coupled to two arms 302 correspondingly via the two first protrusions 304. The two second protrusions 306 extend though the two round holes 202 correspondingly. Therefore, the holding member 300 holding the eyeball 100 is mounted on the inner surface of the housing 200, and can rotate around the axis extending through the two round holes 202.

When both the first electromagnet 310 and the second electromagnet 206 are deactivated, the simulated eye 10 is in a first state. In the first state, the first magnetic member 106 is attracted by the magnet 308, and the magnet 308 is attracted by the second magnetic member 204. As a result, the iris 102, the first magnetic member 106, the magnet 308, and the second magnetic member 204 are aligned in a straight line, and the iris 102 is substantially in the middle of the simulated eye 10.

When the first electromagnets 310 are activated in an alternating manner at a predetermined time interval, for example, 0.05 seconds, the simulated eye 10 is in a second state. In the second state, the first magnetic member 106 is attracted by one of the first electromagnets 310. As a result, the eyeball 100 is driven to rotate in the first direction A repeatedly. As a result, the iris 102 is rotated in the first direction A repeatedly. Furthermore, the rotatable angle range of the iris 102 is determined by the position of the first electromagnet 310 in the arms 302. The first electromagnets 310 are set in a predetermined positions so that the eyeball 100 can rotate within a predetermined angle of rotation along the first direction A.

When the second electromagnets 206 are activated in an alternating manner at a predetermined time interval, for example, 0.05 seconds, the simulated eye 10 is in a third state. In the third state, the magnet 308 is attracted by one of the second electromagnet 206 in turn. As a result, the holding member 300 holding the eyeball 100 is driven to rotate in the second direction B repeatedly. As a result, the iris 102 is rotated in the second direction B repeatedly. Furthermore, the rotatable angle range of the holding member 300 is determined by the position of the second electromagnets 206 mounted on the inner surface of the housing 200, accordingly, the second electromagnets 206 are set in a desired position so that the eyeball 100 can rotate within a predetermined angle of rotation along the second direction B.

Furthermore, the eyeball 100 can be rotated in different directions by controlling both the first electromagnet 310 and the second electromagnet 206, and can be among in the first state, the second state, and the third state. As a result, a function of the simulated eye 100 is achieved to simulate human eyes' rotations.

Certain terminology is used herein for the convenience of the reader only and is not to be taken as a limitation on the scope of the disclosure. For example, words such as "up", "down", "left", "right", and the like merely describe the configuration shown in the Figures. The element or elements of any embodiment of the present disclosure may be oriented in any direction, and the terminology, therefore, should be understood as encompassing such variations unless otherwise specified.

Although the present disclosure has been specifically described on the basis of the embodiments thereof, the disclosure is not to be construed as being limited thereto. Various changes or modifications may be made to the embodiments without departing from the scope and spirit of the disclosure.

What is claimed is:

1. A simulated eye, comprising:

an eyeball defining two recesses therein;

a housing for receiving the eyeball, two holes being defined in the housing; and a holding member comprising four curved arms, the four arms being distributed in cruciform symmetry and extended in a same direction, and having substantially the same curvature corresponding to the eyeball, the four arms being fixed together to form a receiving space for receiving the eyeball, two first protrusions protruding from an inner sidewall of opposite arms, and two second protrusions protruding from an outer sidewall of the other opposite arms;

wherein, the eyeball is rotatable relative to the holding member in a first direction via the two first protrusions engaged with the two recesses, and further rotatable relative to the housing in a second direction via the two second protrusion engaged with the two holes wherein the eyeball comprises at least one first magnetic member, the holding member comprises at least one first electromagnet, magnetism generated by the at least one first magnetic member and the at least one first electromagnet drives the eyeball to rotate relative to the holding member in the first direction, wherein the holding member comprises at least one magnet, the housing comprises at least one second electromagnet, and magnetism generated by the at least one magnet and the at least one second electromagnet drives the holding member to rotate relative to the housing in the second direction.

2. The simulated eye as described in claim 1, wherein the first direction is substantially perpendicular to the second direction.

3. The simulated eye as described in claim 1, wherein the first two protrusions are substantially coplanar with the two second protrusions.

4. The simulated eye as described in claim 1, wherein the eyeball comprises a first magnetic member, each arm having a first protrusion comprises a first electromagnet, magnetism generated by the first magnetic member and the first electromagnet drive the eyeball rotate relative to the holding member in the first direction.

5. The simulated eye as described in claim 1, wherein the holding member comprises a magnet, the housing has two second electromagnets, magnetism generated by the magnet and the second electromagnets drive the eyeball rotate relative to the holding member in the second direction.

6. The simulated eye as described in claim 1, wherein an iris is disposed on the eyeball.

* * * * *